US005731257A

United States Patent [19]

Qunicy III et al.

[11] Patent Number: 5,731,257

[45] Date of Patent: Mar. 24, 1998

[54] HIGH SURFACE AREA IRON-MAGNESIUM SMOKE SUPPRESSIVE COMPOSITIONS

[75] Inventors: Roger Bradshaw Qunicy III, Alpharetta; William Francis Cartwright, Roswell, both of Ga.

[73] Assignee: Kimberly-Clark Worldwide Inc., Neenah, Wis.

[21] Appl. No.: 825,035

[22] Filed: Mar. 26, 1997

Related U.S. Application Data

[63] Continuation of Ser. No. 384,052, Feb. 6, 1995, abandoned, which is a continuation of Ser. No. 90,348, Jul. 9, 1993, Pat. No. 5,386,838.

[51] Int. Cl.[6] ..... B01J 31/00; B01J 23/58

[52] U.S. Cl. ..... 502/328; 502/102; 502/325

[58] Field of Search ..... 502/102, 325, 502/328; 424/682, 646, 688, 692

[56] References Cited

U.S. PATENT DOCUMENTS

| | | | |
|---|---|---|---|
| 2,003,690 | 6/1935 | Lewton | 131/31 |
| 3,993,607 | 11/1976 | Florence | 260/2.5 FP |
| 4,246,359 | 1/1981 | Whelan | 521/92 |
| 4,296,762 | 10/1981 | Eicher et al. | 131/359 |
| 4,333,484 | 6/1982 | Keritsis | 131/359 |
| 4,396,730 | 8/1983 | Imahashi | 523/200 |
| 4,420,002 | 12/1983 | Cline | 131/334 |
| 4,450,847 | 5/1984 | Owens | 131/365 |
| 4,506,684 | 3/1985 | Keritsis | 131/369 |
| 4,805,644 | 2/1989 | Hampl, Jr. et al. | 131/365 |
| 4,881,557 | 11/1989 | Martin | 131/365 |
| 4,915,118 | 4/1990 | Kaufman et al. | 131/365 |
| 5,060,676 | 10/1991 | Hearn et al. | 131/369 |
| 5,253,660 | 10/1993 | Dixit et al. | 131/35 |
| 5,386,838 | 2/1995 | Quincy, III et al. | 131/365 |

OTHER PUBLICATIONS

Keating et al., "Magnesium Hydroxide: A Halogen Free Flame and Smoke Suppressant for Polypropylene," Modif. Addit., Div. Fire Retard. Chem. Assoc., pp. 123–132, 1985.

Scarano et al., "Dioxygen Adducts of Iron (II) at the Surface of Solid Solutions," *Journal of Molecular Catalysis*, 38, pp. 287–293, 1986.

Naono, Hiromitu, "Micropore Formation Due to Thermal Decomposition of Magnesium Hydroxide," *Colloids and Surfaces*, 37, pp. 55–70, 1989.

Schiavello et al., "Structure and Catalytic Activity of Iron Oxide and Magnesium Oxide Solid Solutions," *Journal of the Chemical Society*, Faraday Transactions, 1, pp. 1642–1648, 1975.

Kamswari, S., "Effect of Method Preparation on the Morphology and Physical Properties of Solid Catalysts," Symp. on Science of Catalysis and Its App. in Industry, FPDIL, Sindri, pp. 22–24, 1979.

Valigi et al., "Structure and Catalytic Activity of Iron Oxide and Magnesium Oxide Solid Solutions," *Journal of the Chemical Society*, Faraday Transactions 1, pp. 1631–1641.

(List continued on next page.)

*Primary Examiner*—Thurman K. Page
*Assistant Examiner*—Kathryne E. Shelborne
*Attorney, Agent, or Firm*—K. V. Sidor

[57] ABSTRACT

A high surface area oxidative catalyst smoke suppressive composition, smoke suppressive articles, and method of making such compositions and articles are disclosed. The smoke suppressive composition is a solid solution comprising a mixture of iron (Fe) and magnesium (Mg) that promotes efficient combustion, articles treated with such compositions, and methods for making such smoke suppressive compositions and articles. The smoke suppressive composition is made by co-precipitating Fe and Mg from an aqueous solution in the presence of a base. The iron-magnesium composition demonstrates high surface area and efficient combustion for embodiments having iron in an amount from approximately 3 mol % to approximately 30 mol % and magnesium in an amount from approximately 97 mol % to approximately 70 mol %. The compositions provide superior smoke suppression for items such as cigarettes and smoke suppressive articles. The smoke suppressive compositions are particularly useful for reducing cigarette sidestream smoke in cigarettes.

8 Claims, 1 Drawing Sheet

OTHER PUBLICATIONS

Hornsby et al., "Mechanism of smoke suppression and fire retardance in polymers containing magnesium hydroxide filler", *Plastics and Rubber Processing and Applications* 11, pp. 45–51, 1989.

Hornsby et al., "Magnesium hydroxide—a combined flame retardant and smoke suppressant filler for thermoplastics," *Plastics and Rubber Procesing and Applications* 6, pp. 169–175, 1986.

2nd Enlarged Edition of Concise Chemical and Technical Dictionary, p. 759.

HIGH SURFACE AREA IRON-MAGNESIUM SMOKE SUPPRESSIVE COMPOSITIONS

This application is a continuation application of application Ser. No. 08/384,052 filed on Feb. 6, 1995, now abandoned, which is a continuation application of application Ser. No. 08/090,348 filed on Jul. 9, 1993, now U.S. Pat. No. 5,386,838, issued on Feb. 7, 1995.

TECHNICAL FIELD OF THE INVENTION

This invention relates to smoke suppression, and in particular, relates to the reduction of smoke produced by burning cigarettes.

BACKGROUND OF THE INVENTION

Smoking articles such as cigarettes or cigars produce sidestream smoke during static burning, i.e. when the smoking article is idle and not being drawn upon by the smoker. The Surgeon General has determined that sidestream smoke is more of a concern than smoke exhaled by a smoker. Sidestream smoke tends to create a smoky atmosphere in closed quarters that may impair vision and is often considered objectionable visually. Sidestream smoke also can be physically irritating, causing a burning sensation in the eyes, nose and throat.

Smoke is a dispersion of solid and liquid particles carried by combustion gases and air. Smoke particles consist of carbon-rich moieties such as tar and soot, water vapor, and oxides of inorganic compounds that result from incomplete combustion. These moieties act as smoke nuclei, initiating condensation and forming smoke. Hornby and Watson, (Magnesium Hydroxide—a Combined Flame Retardant and Smoke Suppressant Filler for Thermoplastics *Plastics and Rubber Processing and Applications* 6:169–175 (1986)) describe plastic polymer combustion and smoke formation as a three step process. In phase one polymer is thermally degraded to simple fuel consisting of polymer fragments and pyrolysis products. In phase two the simple fuels are converted to reactive aromatic intermediates that subsequently form either stable polycyclic aromatic hydrocarbons or smoke nuclei. In phase three smoke nuclei coagulate and agglomerate to form smoke particles. Magnesium hydroxide provides a high surface area where carbon deposits and subsequently is volatilized during and after flame extinction to reduce the number of smoke formation.

Many attempts to reduce sidestream smoke have been made. For example, magnesium hydroxide ($Mg(OH)_2$) has been used commercially in cigarette paper to reduce visible sidestream smoke in cigarettes. $Mg(OH)_2$ decomposes to MgO at ca. 360° C., with a concomitant increase in surface area. U.S. Pat. No. 4,805,644 to Hampl teaches that sidestream smoke reduction is related to the surface area of cigarette wrapper paper filler. Some patents relating to sidestream smoke reduction are as follows.

U.S. Pat. No. 4,420,002 to Cline is directed to a cellulosic wrapper for tobacco that contains 5% to 50% magnesium hydroxide filler having a median particle size of less than 10 micrometers, and an unreactive magnesium oxide filler. The magnesium hydroxide filler is preferably added to the fiber pulp furnish, thus maximizing contact between fiber and filler.

U.S. Pat. No. 4,450,847 to Owens is directed to a cellulosic wrapper containing an amorphous gel of magnesium hydroxide freshly precipitated on the fibers of the sheet as a filler, plus unreactive magnesium oxide, calcium carbonate or both as co-filler(s). The wrapper also contains 2% to 8% by weight potassium acetate as a chemical adjuvant. The '847 patent describes methods of adding filler material during the process of making cigarette paper.

U.S. Pat. No. 4,881,557 to Martin is directed to cigarette paper that incorporates a mixture of freshly precipitated magnesium hydroxides having a median particle size of about 15 micrometers. The magnesium hydroxide is precipitated externally and subsequently added to the paper's fibers. This is in contrast to previous methods, such as the method of the '847 patent noted above wherein in situ precipitation is employed. The '557 patent teaches that increasing levels of magnesium hydroxides over 15% is not feasible because smoking articles such as cigarettes made with wrapping paper containing high percentages of magnesium hydroxide self-extinguish or are non-combustible. The '557 patent also describes methods of adding filler material during the process of making cigarette paper.

U.S. Pat. No. 4,915,118 to Kaufman et al. is directed to a reduced smoke wrapper containing freshly precipitated magnesium hydroxide filler precipitated by an equal or near equal stoichiometric addition rate process in the presence of particulate magnesium hydroxide and/or calcium co-fillers, and in the absence of cellulosic pulp fibers.

Despite the above-described effort, there is still a need for reducing the amount of smoke produced by burning articles, and in particular, reducing the amount of smoke produced by burning cigarettes.

SUMMARY OF THE INVENTION

The above-described need is met by producing an unusually high surface area solid solution comprising a mixture of iron (Fe) and magnesium (Mg) that promotes efficient combustion, articles treated with such compositions, and methods for making such smoke suppressive compositions and articles. The smoke suppressive compositions are made by co-precipitating Fe and Mg from an aqueous solution in the presence of a base. The iron-magnesium composition demonstrates high surface area for embodiments having iron in an amount from approximately 3 mol % to approximately 30 mol % and magnesium in an amount from approximately 97 mol % to approximately 70 mol %.

The smoke suppressive Fe-Mg composition is an oxidation catalyst, and reduces the amount of smoke produced by burning articles. The compositions provide superior smoke suppression for items such as cigarettes and smoke suppressive articles. The smoke suppressive compositions are particularly useful for reducing cigarette sidestream smoke when incorporated in cigarette wrapping paper.

Accordingly, an object of the present invention is to reduce the amount of smoke produced by burning articles.

Another object of the invention is to provide an iron-magnesium solid solution composition that reduces the amount of smoke produced by burning articles.

A further object of the invention is to provide an iron-magnesium composition that efficiently catalyzes combustion and which possesses high surface area when heated to temperatures above approximately 100° C.

Yet another object of the invention is to provide smoke suppressive articles.

A further object of the invention is to provide cigarette paper containing an Fe-Mg solid solution composition that reduces the amount of sidestream smoke produced in cigarettes.

Other objects, features, and advantages of the present invention will become apparent from the following detailed description and claims.

DETAILED DESCRIPTION OF THE INVENTION

Figure 1:
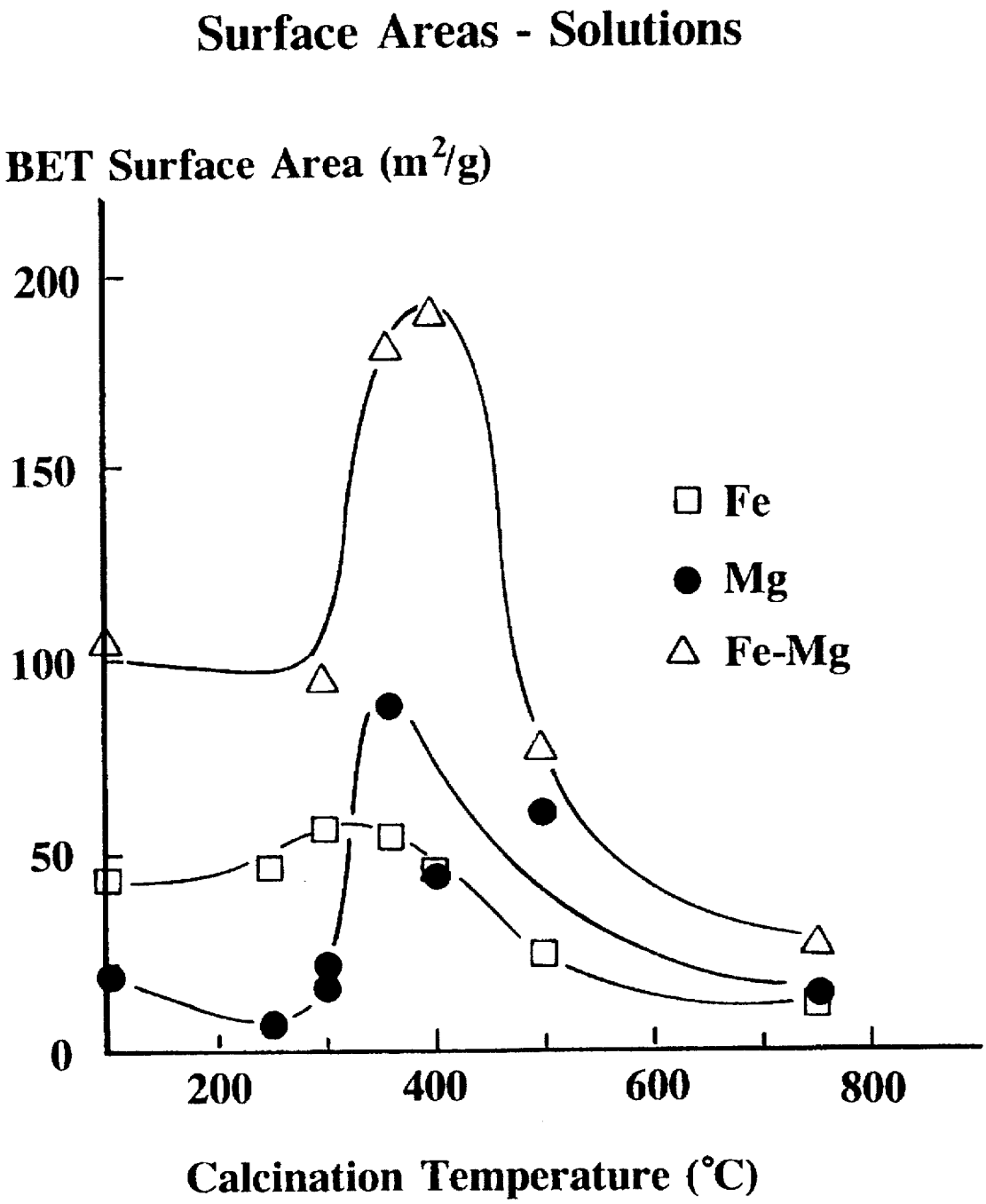
FIG. 1 is a graph depicting the surface areas of iron hydroxide-oxide, magnesium hydroxide-oxide, and an iron-magnesium mixed hydroxide-oxide solid solution composition as a function of calcination temperature.

As described above, the present invention encompasses a composition containing a mixture of iron (Fe) and magnesium (Mg) hydroxides and oxides that possesses exceptionally high surface area when heated and promotes efficient combustion, smoke suppressive articles treated with such a composition, and methods for making such smoke suppressive compositions and articles. The smoke suppressive compositions are made by co-precipitating Fe and Mg from solution in the presence of a strong base. In contrast to simple physical mixtures of iron hydroxide and magnesium hydroxide, the mixed iron-magnesium (Fe-Mg) composition is a solid solution, wherein the Fe is believed to be intercalated in the Mg crystal structure, forming a well dispersed iron phase for optimally efficient oxidation catalysis.

The smoke suppressive iron-magnesium composition of the present invention shows high surface area for embodiments including iron in an amount from approximately 3 mol % to approximately 30 mol % of the composition and magnesium in an amount from approximately 70 mol % to approximately 97 mol % of the composition. More particularly, these embodiments have a surface area from approximately 100 $m^2/g$ to approximately 225 $m^2/g$ when heated to a temperature between approximately 100° C. and approximately 500° C. A preferred embodiment includes iron in an amount from approximately 3 mol % to approximately 20 mol % of the composition, and includes magnesium in an amount from approximately 97 mol % to approximately 80 mol % of the composition. The most preferred embodiment includes iron in an amount from approximately 5 mol % to approximately 10 mol % of the composition, and magnesium in an amount from approximately 95 mol % to approximately 90 mol % of the composition.

The unit mol % used to describe the ratio of Fe to Mg in the composition is the mole fraction multiplied by 100 to give the percentage. Mol % represents the number of moles of a particular metal (for example Fe) divided by the number of moles of total metal (Fe plus Mg) initially present in aqueous solution, multiplied by 100. The molar ratio of metals present in the composition is essentially identical to the initial metal molar ratio in the solution from which the composition is precipitated.

For example, a solution 1 molar in metal that contains 5 mol % iron and 95 mol % magnesium yields a mixed Fe-Mg hydroxide precipitate having approximately 5 mol % Fe and 95 mol % magnesium. Surprisingly, the iron-magnesium composition has a surface area from approximately 100 $m^2/g$ to approximately 225 $m^2/g$ when heated to temperatures between approximately 100° C. and approximately 500° C. A preferred high surface area composition comprises approximately 5 mol % Fe and approximately 95 mol % Mg, and has a surface area of approximately 200 $m^2/g$ when heated to approximately 400° C.

The iron-magnesium composition of the present invention possesses surprising and unexpected properties. First, it possesses exceptionally high surface area; substantially greater than would be predicted based on the surface area of iron hydroxide and magnesium hydroxide alone prepared under identical conditions. FIG. 1 shows that the Fe-Mg composition possesses substantially more surface area than either Fe or Mg alone, both at low temperatures and at temperatures up to approximately 500° C. While not wanting to be bound by the following theory, it is believed that the Fe-Mg smoke suppressive composition has exceptionally high surface area because the Fe intercalates between the layers in the magnesium hydroxide lattice during precipitation. In the dry state, the composition is primarily a mixed hydroxide of Fe and Mg at low temperatures. After heating to temperatures above about 350° C., a substantial portion of the Fe and Mg in the composition is in the form of oxides.

Secondly, the Fe-Mg composition provides unexpectedly more efficient and more complete combustion of material. The more efficient combustion results in smaller molecular weight oxygen-containing by-products being produced instead of primarily carbon- and hydrogen-containing products, which are characteristic of less efficient combustion. Smaller molecular weight oxidation products result in less smoke being produced because the amount of particulate matter, and accompanying aerosol formation, is reduced. While not wanting to be bound by the following theory, it is believed that the iron in the mixed Fe-Mg solid solution acts synergistically to efficiently catalyze oxidation of material during burning.

The high surface area mixed iron-magnesium composition provides superior smoke suppression for items such as smoking article wrapper paper and other smoke suppressive articles. Because the Fe-Mg compositions are useful for reducing the amount of smoke produced by burning articles, they have many potential applications in areas such as smoke suppressive children's toys, smoke suppressive fabrics and smoke suppressive construction materials. An important application of the composition is in the production of smoke suppressive plastics and polymers. The Fe-Mg composition is particularly useful for reducing cigarette sidestream smoke when incorporated in cigarette wrapping paper.

The solid solution Fe-Mg composition is prepared by precipitation from an aqueous solution containing iron and magnesium. The precipitate may be used as is, e.g. adding it to paper pulp slurry, or it may be dried by a drying process well known in the art. Examples of such drying processes include drying in an oven at elevated temperatures, and filter drying. An iron- and magnesium-containing solution is prepared using any of the water soluble ferrous iron- and magnesium-containing compounds known in the art. Examples of such iron compounds include ferrous halides such as $FeCl_2$, ferrous sulfate ($FeSO_4 \cdot 7H_2O$), ferrous acetate ($Fe(C_2H_3O_2)_2 \cdot 4H_2O$), and ferrous nitrate ($Fe(NO_3)_2$). The most preferred water soluble iron compound is ferrous sulfate. Examples of such magnesium compounds include magnesium halides such as magnesium chloride ($MgCl_2$), magnesium nitrate ($Mg(NO_3)_2$), and magnesium sulfate ($MgSO_4 \cdot 7H_2O$). The preferred water soluble magnesium compound is magnesium sulfate.

The precipitation is accomplished by adding a strong base to the iron- and magnesium-containing aqueous solution. Examples of strong bases include sodium hydroxide and potassium hydroxide; ammonium hydroxide also can be used. The preferred strong base is sodium hydroxide. The molar ratio of iron and magnesium, respectively, in the aqueous solution is adjusted to achieve the desired ratio of iron to magnesium in the solid solution composition. The ratio of iron to magnesium initially established in the aqueous solution is essentially the ratio found in the resulting Fe-Mg mixed hydroxide-oxide composition after precipitation. This is due to the fact that excess base is added to the solution which causes essentially all of the iron and magnesium in the solution to precipitate out as the Fe-Mg mixed hydroxide-oxide.

Smoke suppressive articles are made by treating articles with the smoke suppressive composition of the present invention. Articles may be treated by incorporating the smoke suppressive composition of the present invention into the article, or by applying the smoke suppressive composition of the present invention to the article. For example, the iron-magnesium composition is incorporated into an article to an intermediate stage of manufacture of the article, or a component of the article, such that the finished article has the iron-magnesium composition as an integral component thereof. The Fe-Mg composition can be added to natural or synthetic materials that are used in the manufacture of an article to render the article smoke suppressive. Of particular interest is the addition of the Fe-Mg composition to plastics and polymers. A particular example of incorporating the smoke suppressive composition into an article is the addition of the Fe-Mg composition to paper pulp to make smoke suppressive cigarette paper.

Smoke suppressive articles are also made by applying the iron-magnesium composition to articles. Such application may be achieved by coating, soaking, spraying, dusting, or otherwise applying the iron-magnesium composition to the article. For example, the smoke suppressive composition is mixed with tobacco to render the tobacco smoke suppressive.

The Fe-Mg composition can be incorporated in or applied to an article prior to heating the composition. An important aspect of the Fe-Mg composition is its unusually high surface area at low calcination, (e.g. approximately 100° C.). This feature provides a smoke suppressive function in the early stages of combustion before a burning article attains the substantially higher temperatures required for iron hydroxide or magnesium hydroxide alone to achieve significant surface area. Alternatively, the composition first may be calcined at temperatures above 100° C., preferably in the range of approximately 300° C. to 400° C., to develop increased surface area, and then incorporated or applied to an article.

The production of smoke suppressive cigarette wrapping paper is accomplished by any of the many methods known in the art for adding filler to paper. For example, precipitated and dried Fe-Mg composition is incorporated into paper by adding the composition to fiber pulps customarily used to make paper. Examples of methods of making paper and adding fillers to cigarette papers are described in U.S. Pat. No. 4,450,847, which is expressly incorporated herein by reference. Alternatively, co-precipitation of the iron-magnesium composition is carried out at the wet end of the paper machine by methods well known to one of ordinary skill in the art of making paper. Still another method of making smoke suppressive paper incorporating the iron-magnesium composition is to swell cellulose in a slurry of sulfate salts of magnesium and iron followed by treatment with a strong base.

Cigarette paper can include up to approximately 50% by weight of the Fe-Mg composition. Preferably, cigarette paper contains approximately 15% by weight of the Fe-Mg composition.

The following examples represent illustrative but non-limiting embodiments of the present invention.

EXAMPLE 1

Precipitates of Mg, Fe and mixed Fe-Mg were prepared for calcination and surface area measurements by the following method.

Precipitation of magnesium hydroxide and iron hydroxide was accomplished by the addition of 4 Normal sodium hydroxide to 1 Molar solutions (kept at approximately 70° C.) of magnesium sulfate and iron sulfate, respectively. The hydroxide precipitates were separated from solution by centrifugation at 2,000 rpm for approximately 5 minutes. The precipitates were washed and centrifuged approximately five times to remove unreacted ions, and then dried at approximately 105° C. for approximately 16 hours. The magnesium hydroxide and iron hydroxide samples are designated as Mg-solution and Fe-solution, respectively.

Co-precipitation of iron-magnesium hydroxides was achieved by the addition of 4 Normal sodium hydroxide to an aqueous solution (kept at approximately 70° C.) containing iron and magnesium sulfate (total metal sulfate concentration of 1 Molar). Two iron-magnesium co-precipitates (5 mol % Fe/95 mol % Mg and 50 mol % Fe/50 mol % Mg) were prepared. The samples were centrifuged and washed approximately four times, and then dried for approximately 16 hours at approximately 105° C. The co-precipitates of iron and magnesium are designated Fe(X)-Mg(X)-solution, where "X" refers to mol %.

Physical mixtures Fe and Mg were prepared by mixing and grinding two commercial solids with mortar and pestle for approximately 5 minutes. The mixtures are expressed as weight percentages; for example, a physical mixture of 5 wt. % yellow iron oxide and 95 wt. % magnesium hydroxide is represented as 5% yellow iron oxide/95% magnesium hydroxide.

SAMPLE CALCINATION

Samples were placed in porcelain crucibles and calcined in a muffle furnace. The desired calcination temperature was reached in approximately 1–2 hours and maintained approximately constant (±10° C.) for an additional 2 hours by adjusting the muffle furnace power supply. After calcination, the samples were ground by mortar and pestle for approximately 5 minutes and then stored in capped vials.

SAMPLE CHARACTERIZATION

Surface areas were measured at −196° C. by the single point Brunauer-Emmett-Teller (BET) method. This method of measuring surface area is well known in the art, as exemplified by Brunauer, E., Emmett, P. H., and Teller, E., *J. Amer. Chem. Soc.* 60, 309 (1938), which is expressly incorporated herein by reference. A commercial surface area measuring apparatus, available from Quantasorb, was used with nitrogen as the adsorbate gas. Commercially available standards of known surface area were used daily to calibrate the instrument. The Fe-Mg catalyst composition was characterized by an elemental analysis technique, Electron Spectroscopy for Chemical Analysis (ESCA), X-ray Diffraction (XRD), Differential Scanning Calorimetry (DSC), Transmission Electron Microscopy (TEM) and visual observation.

RESULTS AND DISCUSSION

Table 1 presents data showing the surface area of each composition as a function of calcination temperature for iron (Fe), magnesium (Mg), and Fe-Mg co-precipitates. The data in Table 1 show that the Fe, Mg, and Fe-Mg samples undergo an increase in surface area at certain calcination temperatures. For example, the sample designated "Mg-solution" increases in surface area from 17 $m^2/g$ at 300° C. to 88 $m^2/g$ at 360° C. The significant increase in surface area for the Mg-solution sample is consistent with the thermal decomposition of the initial material (e.g. a metal hydroxide)

to an oxide with many voids. The data also demonstrate that as the calcination temperature is increased above 360° C. for the Mg-solution sample, the surface area decreases significantly. The decrease in surface area at high calcination temperatures has been attributed to the collapse of the voids or open structure of the metal oxide, a phenomenon referred to as sintering. The data in Table 1 shows that sintering occurs at high calcination temperatures for all Fe, Mg, and Fe-Mg samples.

Comparing the data presented in Table 1 it can be seen that Fe(5)-Mg(95)-co-precipitated composition provides superior high surface area over a wide range of temperatures; this sample has an unexpectedly high initial surface area of approximately 100 $m^2/g$ in the dried state and at low temperatures. No other sample in the dried state approaches this high surface area. Additionally, the Fe(5)-Mg(95) composition possesses an exceptionally high surface area of approximately 225 $m^2/g$ at temperatures of approximately 350° C. to 400° C. Still further, the composition retains a surface area of >75 $m^2/g$ for temperatures between 400° C. and 500° C. The high surface area retained even at high temperatures indicates that less sintering is occurring in the Fe-Mg solid solution.

FIG. 1 shows a plot of surface area versus calcination temperature for the Fe(5)-Mg(95)-solution sample. Also shown for comparison are plots for the Fe-solution and Mg-solution samples, which were prepared by the same process as the Fe(5)-Mg(95)-solution sample. It can be seen in FIG. 1 that for calcination temperatures below approximately 500° C. the surface areas of the Fe(5)-Mg(95)-solution sample are significantly higher than predicted from the corresponding values for Fe-solution and Mg-solution. For example, based on the surface areas of the dried Fe-solution and Mg-solution samples (43 $m^2/g$ and 18 $m^2/g$, respectively, Table 1), a surface area of approximately 20 $m^2/g$ would be predicted for a dried sample containing 5 mol % Fe/95 mol % Mg (the composition of Fe(5)-Mg(95) -solution). In fact, the Fe-Mg co-precipitated solid solution has a surface area of approximately 100 $m^2/g$, some five times greater than the predicted value.

TABLE 1

Mass Loss and Surface Area Data for Iron (Fe), Magnesium (Mg), and Fe—Mg Samples

| | Calcination Temperature[1] | | | | | | |
|---|---|---|---|---|---|---|---|
| Sample | 105° C. | 250° C. | 300° C. | 360° C. | 400° C. | 500° C. | 750° C. |
| Fe-solution Surface Area ($m^2/g$): | 43 | 47 | 57 | 55 | 46 | 23 | 11 |
| Mg-solution Surface Area ($m^2/g$): | 18 | 6 | 17 | 88 | 45 | 61 | 14 |
| Fe(5)—Mg (95)-solution Surface Area ($m^2/g$): | 104 | — | 95 | 181 | 190 | 78 | 27 |
| Fe(50)—Mg (50)-solution Surface Area ($m^2/g$): | 29 | — | 52 | 68 | 69 | 39 | 18 |
| 5% Yellow Fe oxide/95% Mg hydroxide Surface Area ($m^2/g$): | 34 | — | 37 | 157 | 200 | 118 | 46 |

TABLE 1-continued

Mass Loss and Surface Area Data for Iron (Fe), Magnesium (Mg), and Fe—Mg Samples

| | Calcination Temperature[1] | | | | | | |
|---|---|---|---|---|---|---|---|
| Sample | 105° C. | 250° C. | 300° C. | 360° C. | 400° C. | 500° C. | 750° C. |
| 50% Yellow Fe Oxide/50% Mg hydroxide Surface Area ($m^2/g$): | 23 | — | 60 | 142 | 113 | 58 | 16 |

[1]For temperatures ≧250° C., samples were calcined in a muffle furnace by the following procedure: 1–2 hours to reach calcination temperature, 2 hours constant temperature (i.e. desired calcination temperature ±10° C.). For temperature of 105° C., samples were dried for 15–20 h.

An elemental analysis technique and ESCA show that the bulk and surface composition of the Fe-Mg high surface oxidative catalyst has the same ratio of mol % Fe to mol % Mg, and the composition in the solid is the same as the composition in the starting solution. The Fe-Mg high surface area oxidative catalyst was analyzed by X-ray diffraction (XRD), Differential scanning calorimetry (DSC) and transmission electron microscopy (TE). TEM reveals that both Fe and Mg are dispersed in the same location throughout the Fe-Mg particles. Additionally, DSC results suggest that the Fe-Mg catalyst is a distinct composition and not a simple physical mixture of Fe hydroxides and magnesium hydroxides. Also, XRD data suggest that Fe intercalates between the layers of magnesium hydroxide. The results of all of these analyses indicate that Fe and Mg are in intimate proximity and suggest that the Fe-Mg precipitate is a Fe-Mg solid solution.

EXAMPLE 2

A scale-up preparation (5 lbs.) of the co-precipitated Fe-Mg composition was conducted using conditions similar to those described above in Example 1 for a 15 g preparation. A comparison of physical properties revealed the following results:

| Property | Small Scale Prep. | Large Scale Prep. |
|---|---|---|
| Nominal Bulk Content | mol % Fe/mol % Mg = 0.053 | mol % Fe/mol % Mg = 0.053 |
| Measured Bulk Content | mol % Fe/mol % Mg = 0.058 | mol % Fe/mol % Mg = 0.054 |
| Surface Area (Dried State) | 104 $m^2/g$ | 89 $m^2/g$ |
| Surface Area (400° C. Calcination) | 190 $m^2/g$ | 208 $m^2/g$ |
| Measured Surface Content | mol % Fe/mol % Mg = 0.059 | mol % Fe/mol % Mg = 0.058 |

These results demonstrate that the scale-up synthesis of the high surface area oxidative catalyst Fe-Mg composition yields the same composition as the small scale composition.

EXAMPLE 3

Cigarettes containing the smoke suppressive composition (22% chalk/15% 5/95 Fe/Mg catalyst) were made and compared against cigarettes not having any smoke suppressant added (37% chalk control), and cigarettes to which magnesium hydroxide was added as a smoke suppressant (22% chalk/15% $Mg(OH)_2$). The following procedure generally describes the preparation of the three cigarette types.

The chalk used was Albacar 5970™, available from Specialty Minerals, Bethlehem, Pa. Paper handsheets were made by conventional techniques, well-known to the art. Filler content was verified by either titrametric or ashing procedures. The papers were nominally made to the following specifications: 45 g/m$^2$ basis weight, permeability of 11–12 cm/min (CORESTA) and 37% filler. These papers were treated on an Atlas Laboratory Wringer to achieve a chemical coating of 9.5% potassium acetate by weight.

The surface area of the handsheet papers was determined by BET, although this method is not particularly accurate for paper materials because of the capillary structure. The Fe-Mg handsheet surface area was some 50% higher than either the chalk filled sheet or the chalk/magnesium hydroxide sheet. This result strongly indicates that the high surface area of the Fe-Mg precipitated catalyst was preserved in the handsheet making process. When the chalk/Fe-Mg sheet and the chalk/Mg(OH)$_2$ containing sheets were ashed at 525° C. for 15 minutes, the surface area of the remaining ashes was 50–60 m$^2$/gm, considerably higher than a chalk filled paper (<10 m$^2$/gm).

The treated papers were then used to hand make cigarettes of 70 mm length without filters using a standard American blend with a density of 0.265 g/cm$^3$. The cigarettes, once made, were further matched for weight, circumference, and pressure drop prior to smoking. The matched cigarettes were smoked according to the Federal Trade Commission (FTC) method used for the determination of mainstream (MS) total particulate matter (TPM). Simultaneously, the sidestream smoke (SS) TPM was quantitated by inserting the cigarette into a chamber. For smoking, a Borgoraldt Single-Port Smoking Machine, available from Borgoraldt of Hamburg, Germany was used. The side stream smoke chamber maintained an air velocity past the cigarette of 40 cm/min. At the exit of the chamber, the SS TPM was collected on filter pads such as Cambridge™ filter pads, available from Borgoraldt of Hamburg, Germany. The difference in weight of the filter pad assembly before and after the cigarettes are smoked provided the SS TPM. Lower total particulate matter values are indicative of less smoke being produced. The results are shown in Table 2, and convincingly demonstrate a clear and significant reduction in the amount of total particulate matter in the sidestream of cigarettes made with the Fe-Mg high surface area oxidative catalyst composition.

For reference purposes, handmade cigarettes were also made from a readily commercially available cigarette paper. This paper has nominal specifications of 25 g/cm$^2$, permeability of 30 cm/min. (CORESTA), 30% calcium carbonate (chalk) filler, and 0.6% burn chemical (as anhydrous citric acid). Cigarettes made with commercial paper were analyzed under identical conditions. This data also is shown in Table 2.

TABLE 2

| | Total Particulate Matter (TPM) (mg/cigarette) | |
|---|---|---|
| | Mainstream | Sidestream |
| Control (37% chalk) | 27.8 | 20.9 |
| Magnesium filler (22% chalk/15% Mg) | 27.9 | 16.0 |
| Iron-Magnesium Catalyst (22% chalk/15% Fe—Mg) | 30.2 | 10.4 |
| Commercial paper | 29.3 | 28.5 |

These data and comparisons demonstrate that the Fe-Mg catalyst reduces sidestream smoke in cigarettes.

EXAMPLE 4

The smoke suppressive Fe-Mg composition was added directly to tobacco to yield a smoke suppressive tobacco mixture. This tobacco mixture was subsequently used to make cigarettes. 92.5 milligrams of Fe-Mg catalyst was added to 925 milligrams of tobacco to prepare a 10% Fe-Mg composition—tobacco mix. Cigarettes were hand rolled using the standard commercial paper of Example 3. Cigarettes were smoked as described above and the total sidestream particulate matter was measured on a per cigarette, and on a per puff basis. The data shown in Table 3 demonstrate that cigarettes which have Fe-Mg (5 mol % Fe/95 mol % Mg)—tobacco mixes result in a reduction (approximately 10%) of total sidestream particulate matter (TPM) than cigarettes made without Fe-Mg catalyst added to the tobacco. Importantly, the sidestream smoke evolved per minute (e.g. per puff) is reduced by 20%.

TABLE 3

| | Sidestream Particulate Matter mg/cig | Number of Puffs | Sidestream Particulate Matter per Puff |
|---|---|---|---|
| Cigarette without Fe—Mg added to tobacco | 26.7 | 10 | 2.67 |
| Cigarette with Fe—Mg added to tobacco | 24.5 | 11.8 | 2.08 |

These data demonstrate that the Fe-Mg composition reduces smoke when mixed directly with tobacco, consistent with a mechanism of promoting oxidation catalysts, and consequently more efficient combustion.

While the invention has been described in detail and with reference to specific embodiments thereof, it will be appreciated by one skilled in the art that various changes and modifications can be made therein without departing from the spirit and scope of the appended claims.

We claim:

1. A composition comprising a precipitate containing iron and magnesium, the precipitate comprising iron in an amount from approximately 3 mol % to approximately 30 mol % of the composition and magnesium in an amount from approximately 70 mol % to approximately 97 mol % of the composition, the composition having a surface area from approximately 100 m$^2$/g to approximately 225 m$^2$/g when heated to a temperature between approximately 100° C. and approximately 500° C., and having a surface area of less than about 46 m$^2$/g when heated to a temperature of approximately 750° C.

2. A composition as in claim 1, wherein iron is present in an amount from approximately 3 mol % to approximately 20 mol % of the composition and magnesium is present in an amount from approximately 80 mol % to approximately 97 mol % of the composition.

3. A composition as in claim 1, wherein iron is present in an amount from approximately 5 mol % to approximately 10 mol % of the composition and magnesium is present in an amount from approximately 90 mol % to approximately 95 mol % of the composition.

4. A composition as in claim 1, wherein iron is present in an amount of approximately 5 mol % of the composition and magnesium is present in an amount of approximately 95 mol % of the composition.

5. A composition comprising a precipitate containing iron and magnesium, the precipitate comprising iron in an amount from approximately 3 mol % to approximately 30 mol % of the composition and magnesium in an amount from approximately 70 mol % to approximately 97 mol % of the composition, the composition having a surface area that is significantly greater when heated to a temperature between approximately 100° C. and approximately 500° C. than the surface area of a precipitate of iron or a precipitate of magnesium, and having a surface area of less than about 46 $m^2/g$ when heated to a temperature of approximately 750° C.

6. A composition as in claim 5, wherein iron is present in an amount from approximately 3 mol % to approximately 20 mol % of the composition and magnesium is present in an amount from approximately 80 mol % to approximately 97 mol % of the composition.

7. A composition as in claim 5, wherein iron is present in an amount from approximately 5 mol % to approximately 10 mol % of the composition and magnesium is present in an amount from approximately 90 mol % to approximately 95 mol % of the composition.

8. A composition as in claim 5, wherein iron is present in an amount of approximately 5 mol % of the composition and magnesium is present in an amount of approximately 95 mol % of the composition.

* * * * *